US008887342B2

(12) United States Patent
Vargas Jünior et al.

(10) Patent No.: US 8,887,342 B2
(45) Date of Patent: Nov. 18, 2014

(54) CLEANING SYSTEM FOR THE REMOVAL OF SEDIMENTS FROM A TANK

(75) Inventors: Joel Ligiério Vargas Jünior, Guaratinguetá (BR); Robson Jorge das Neves Gomes, Sao Paulo (BR)

(73) Assignee: Ice Do Brasil Ltda, Piquete (ES)

( * ) Notice: Subject to any disclaimer, the term of this patent is extended or adjusted under 35 U.S.C. 154(b) by 0 days.

(21) Appl. No.: 13/443,320

(22) Filed: Apr. 10, 2012

(65) Prior Publication Data

US 2013/0263399 A1 Oct. 10, 2013

(51) Int. Cl.
*B08B 9/08* (2006.01)

(52) U.S. Cl.
USPC ..... 15/56; 15/246.5

(58) Field of Classification Search
USPC ..... 15/56, 246.5
See application file for complete search history.

(56) References Cited

U.S. PATENT DOCUMENTS

| | | | | |
|---|---|---|---|---|
| 2,067,105 A * | 1/1937 | Stevens et al. | ..... | 15/246.5 |
| 8,397,334 B2 * | 3/2013 | Ryffel | ..... | 15/56 |

FOREIGN PATENT DOCUMENTS

| | | | |
|---|---|---|---|
| DE | 102 37 431 | * | 3/2004 |
| EP | 0 275 690 | * | 7/1988 |
| FR | 2 537 465 | * | 6/1984 |
| JP | 9-239336 | * | 9/1997 |

* cited by examiner

*Primary Examiner* — Randall Chin
(74) *Attorney, Agent, or Firm* — Moore & Van Allen PLLC; Henry B. Ward, III

(57) ABSTRACT

This invention addresses a cleaning system for the removal of sediments from a tank, the tank being fitted with at least an inspection hatch and/or a cleaning hatch, the cleaning system being fitted with a power system, a traction system, and a cleaning device.

15 Claims, 3 Drawing Sheets

CLEANING SYSTEM FOR THE REMOVAL OF SEDIMENTS FROM A TANK

BACKGROUND

Oil companies currently use tanks and reservoirs to store crude oil or oil products, which will later be processed or transported to other storage locations.

In the course of this use, storage tanks build up sediments from oil or oil products, particularly in their lower sections. These sediments are commonly called "sludges" and, if not removed regularly, reduce the storage capacity of the tank. Furthermore, excess sediments may adversely affect the quality of the oil and oil products.

These sediments are normally removed manually, using shovels and scrapers, more specifically, with spades, buckets or wheelbarrows if necessary. Moreover, a large manual labor force is needed, as these workers must work in the tank all at the same time.

A problem arising from this technique is the fact that workers are exposed to a high level of risk for accidents and pollution.

Furthermore, this technique presents a low level of efficiency, as cleaning activities may take up to around eight months, depending on the size of the tank, resulting in high maintenance costs, due to the large labor force used of some 35 people, in addition to the fact that the equipment remains out of operation for a lengthy period.

Consequently, there is no system constituting the state of the art that removes sediments from storage tanks in a fast and efficient manner and at low cost.

BRIEF SUMMARY

Embodiments of the present invention address the above needs and/or achieve other advantages by providing a cleanings system for the removal of sediments from a tank.

The first purpose of this invention is to provide a cleaning system that can remove sediments from storage tanks in a fast and efficient manner.

A second purpose of this invention is to provide a cleaning system that uses a small specialized labor force.

A third purpose of this invention is to provide a low cost cleaning system.

A fourth purpose of this invention is to provide a cleaning system equipped with a device that is easy to handle.

The purposes are attained through a cleaning system for the removal of sediments from a tank, with the tank being fitted with at least an inspection hatch and/or a cleaning hatch and the system being equipped with at least one power system; a traction system driven by the power system; a traction cable connected to the traction system; a guide shaped to run the cable; and a cleaning device equipped with a plate and a flexible element, being connected to the traction cable.

BRIEF DESCRIPTION OF THE DRAWINGS

Figure 1:
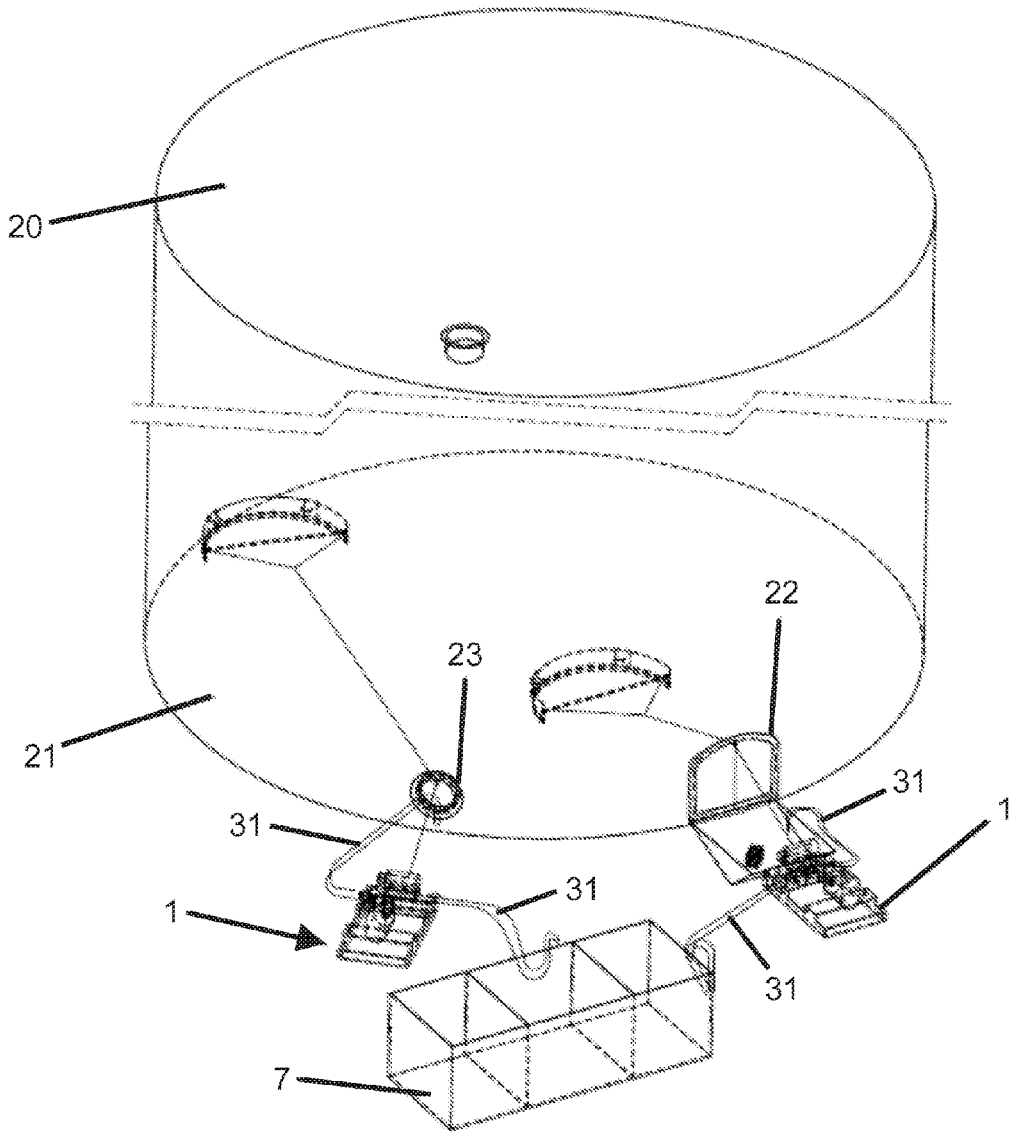
Figure 2:
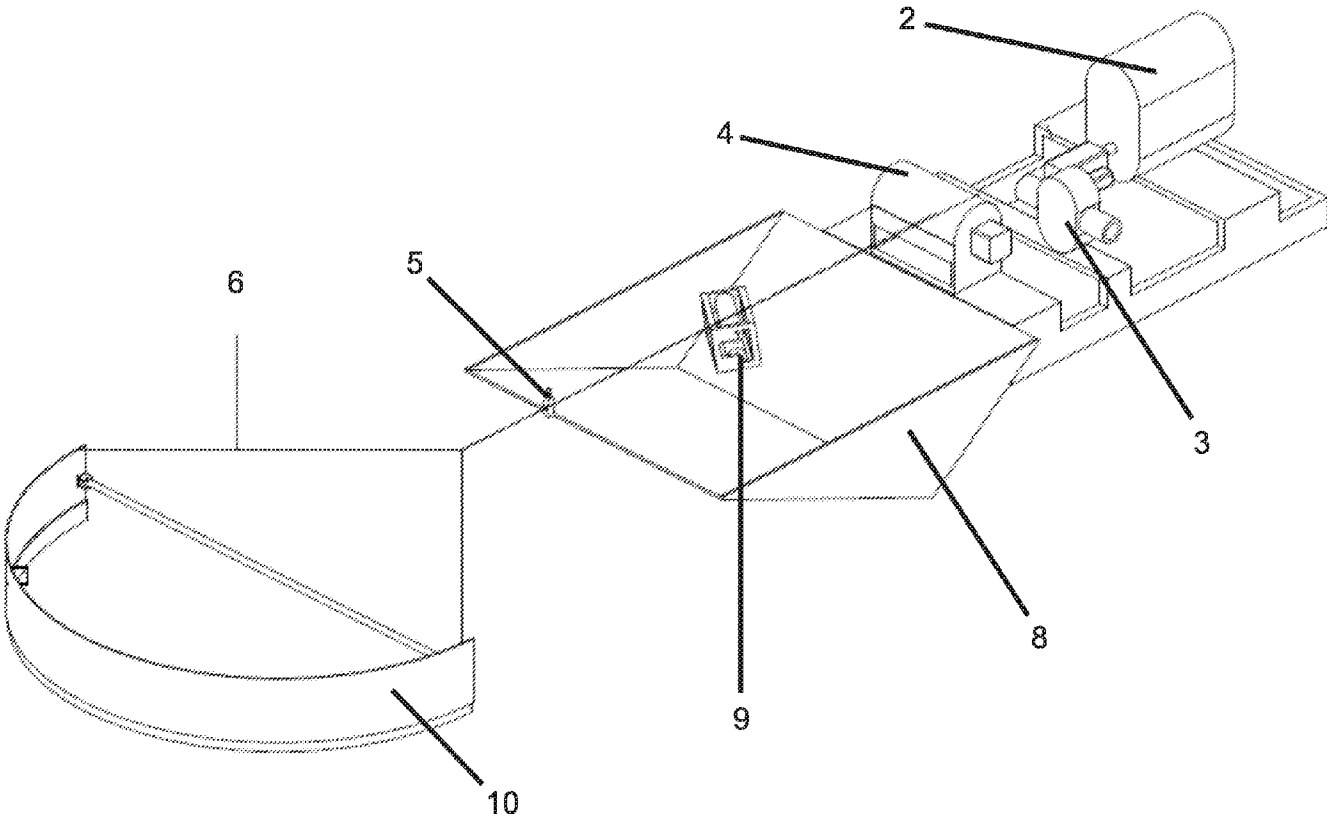
Figure 3:
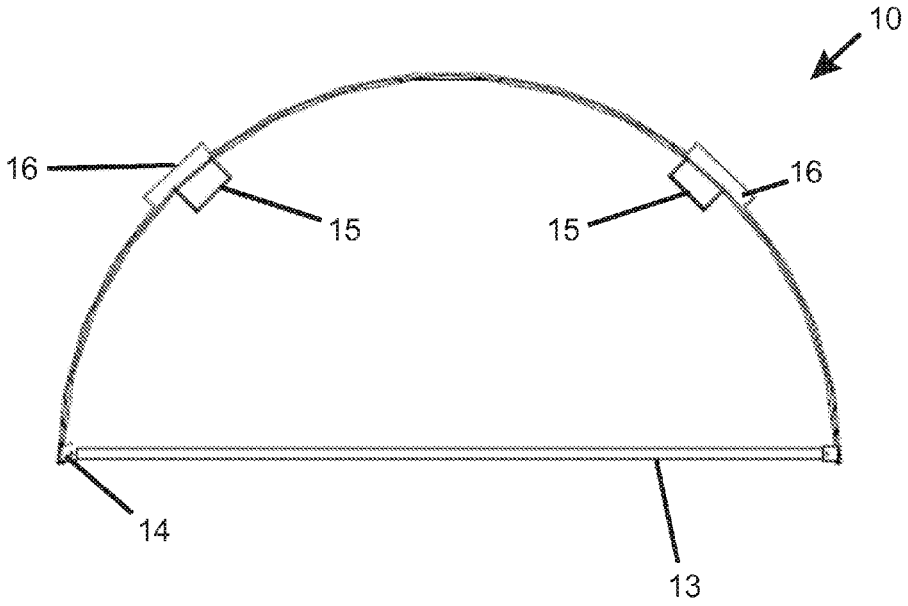
Figure 4:
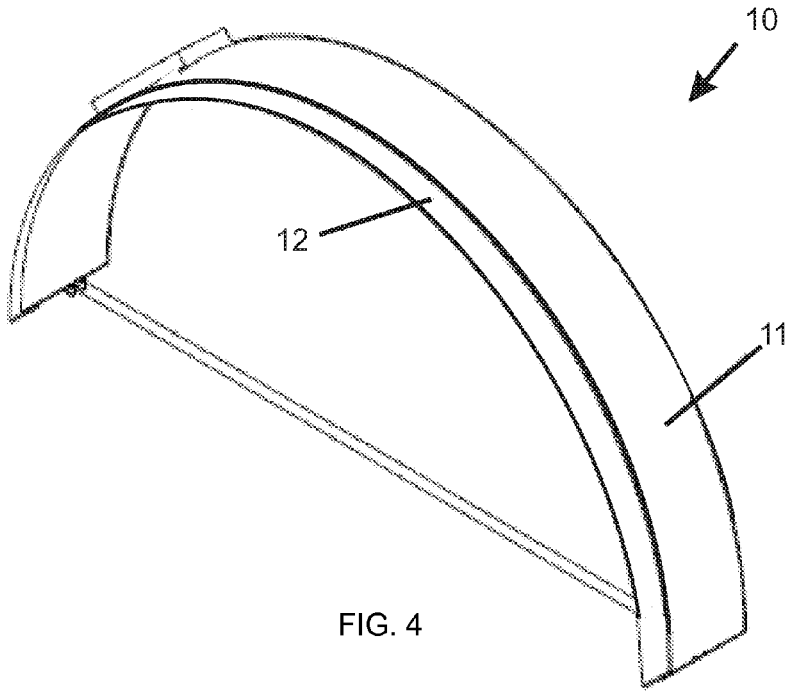

Having thus described embodiments of the invention in general terms, reference will now be made to the accompanying drawings, wherein:

FIG. 1 presents a perspective view of a tank to which two embodiments of the tank cleaning system are connected;

FIG. 2 presents a perspective view of the tank cleaning system addressed by this invention;

FIG. 3 presents a top view of the tank cleaning device addressed by this invention;

FIG. 4 presents a perspective view of the cleaning device.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to elements throughout. Where possible, any terms expressed in the singular form herein are meant to also include the plural form and vice versa, unless explicitly stated otherwise.

FIGS. 1 and 2 illustrate a preferred embodiment of a cleaning system 1 for cleaning a tank 20.

The tank 20 is equipped with a lower section 21 and two openings, with the first opening called the cleaning hatch 22, which normally has a width of 1.5 meters by a height of 1.2 meters, and the second opening called the inspection hatch 23, which is preferably circular in shape, with a diameter of 24 inches. The tank 20 is cylindrical in shape, although it may be shaped differently, whereby its configuration is adapted to the location where it will be used and the type of material to be stored therein.

The cleaning system 1 is comprised of a power system 2, which preferably consists of an engine, a traction system 4, a guide 5, a traction cable 6, and a cleaning device 10. The cleaning system 1 may be arrayed in the cleaning hatch 22 or the inspection hatch 23, as its configuration allows it to be used in both hatches 22, 23.

As may be noted in FIG. 2, the cleaning device 10 is connected to the traction system 4 by a traction cable 6; the traction system 4 is driven by the power system 2 in order to move the cleaning device 10; more specifically, the traction system 4 pulls the cleaning device 10 towards the cleaning hatch 22 or the inspection hatch 23.

The guide 5 is clamped to the upper section of the hatches 22, 23 and is used to guide the traction cable 6 while in use, steering the cleaning device 10 in order to ensure that its stabilizing bar 13 is preferably parallel to the entrance of hatch 22, 23, thus facilitating the removal of the sediments.

In an alternative embodiment, the cleaning system 1 is also comprised of a pump 3 and a reservoir 7. Driven by the power system 2, the pump 3 is used to suction sediments out of the tank 20 and transport them to the reservoir 7 through the hoses 31.

Additionally, when the cleaning system 1 is arrayed in the cleaning hatch 22, it may also be comprised of a grinding device 9, whose purpose is to reduce the size of sediments in order to facilitate the suction thereof. Furthermore, a drip pan 8 may be placed alongside the traction system 4, thus enlarging the sediment collection area. The drip pan 8 is connected to the cleaning hatch 22.

FIGS. 3 and 4 illustrate a preferred embodiment of the cleaning device 10, being equipped with a plate 11, a flexible element 12, the stabilizing bar 13, clamping elements 14, a handle 15 and one support place 16.

As may be noted in FIG. 3, the stabilizing bar 13 is clamped to the ends of the plate 11 by clamping elements 14, whereby the plate 11 is rigid enough to withstand traction when drawn along. Furthermore, the stabilizing bar 13 endows the plate 11 with a semi-circular shape. This configuration is used to adapt to the inner walls of the tank 20, which normally has a cylindrical inner wall. This type of configuration allows easier removal of sediments located close to the wall or the tank 20, meaning that the device is parallel but very close to such wall.

The flexible element 12 is associated with the lower section of the plate 11, in order to remove sediments from the lower section 21 of the tank 20.

As may be noted, the cleaning device 10 is merely drawn by the traction system 4 towards the hatches 22, 23. Consequently, in order for it to move in a direction other than that of the traction system 4, the handle 15 must be used, which is located inside the plate 11, so that the operators can steer the cleaning device 10 to the section of the tank 20 that requires cleaning. Consequently, there are fewer workers in the tank 20, as only three workers are needed to handle the cleaning device 10, with two of them carrying the cleaning device 10 by the handles 15 and the third one carrying the device by the stabilizing bar 13.

Additionally, the cleaning device 10 has a support place 16 located on the outside of the plate 11 that, when in operation, is used for the operator to sit and move along with the cleaning device 10. This also helps compress the flexible element 12 against the lower section 21 of the tank 20, whereby all the solid wastes in the tank 20 are carried along to the nearest hatch 22, 23. Moreover, the cleaning device 10 may also be fitted with a magnetic base (not shown), in order to replace the operator when the cleaning device 10 must be compressed against the lower section 21 of the tank 20.

Consequently, the plate 11 is preferably made from aluminum. However, other types of materials may be used such as polymers or even other types of metal materials, for example. Additionally, the plate 11 is semicircular in shape, although other types of shapes may be used with this configuration used in order to adapt to the inner walls of the tank 20.

The flexible element 12 preferably made from rubber. However, other types of materials may be used, such as polymers for example. It must be stressed that the materials comprising the flexible element 12 may not cause sparks when entering into contact with the lower section 21 of the tank 20, as the sediments may be inflammable, depending of the place of use.

The guide 5 is preferably a pulley, although other types of guides may be used which ensure that that the cleaning device 10 is parallel to the hatches 22, 23 when close to them.

The power system 2 is preferably an electric engine, although other types of engines may be used such as a pneumatic engine, a hydraulic engine or even a combustion engine, for example.

The traction cable 6 is preferably a steel cable, although other types of cables and materials may be used such as Nylon®, for example. It should be noted that the traction cable used must but be strong enough to withstand the drawing power of the traction system 4.

A solution is thus reached through which the cleaning system 1 is able to remove sediments from tanks 20 in a fast and efficient manner. Another advantage presented by this invention is the fact that the cleaning time is shortened by approximately six months, whereby the tank is halted for an average of two months, with lower maintenance costs and shorter periods during which the tank is out of operation.

Additionally, another advantage presented by this invention is the fact that only a small specialized labor force is required, with only three workers needed in the tank 20. Consequently, the cleaning system 1 becomes a low cost system when compared to the technique used in the state of the art.

Furthermore, another advantage attained by this invention is the fact that the cleaning device 10 can be handled easily by its operators.

Having described examples of preferred materializations, it must be understood that the scope of this invention encompasses other possible variations, being limited only by the content of the appended Claims, with possible equivalents being included therein.

What is claimed is:

1. A cleaning system for cleaning a tank, the tank being fitted with at least one of an inspection hatch or a cleaning hatch, wherein the cleaning system comprises at least:

a power system;

a traction system driven by the power system;

a traction cable connected to the traction system;

a guide shaped to run the traction cable;

a cleaning device fitted with a plate and a flexible element, wherein the cleaning device is connected to the traction cable;

a reservoir; and a pump, wherein the pump is configured to suction sediments out of the tank and pipe the sediments to the reservoir through hoses.

2. The cleaning system according to claim 1, wherein the flexible element is clamped to a lower section of the plate such that the flexible element surrounds an entire lower section of the plate.

3. The cleaning system according to claim 1, wherein the plate is semicircular in shape.

4. The cleaning system according to claim 3, wherein edges of the plate are fixed through a stabilizing bar.

5. The cleaning system according to claim 1, wherein the cleaning system is equipped with a drip pan and at least one grinding device, with the drip pan being connected to the cleaning hatch.

6. The cleaning system according to claim 1, wherein the cleaning device is also fitted with clamping elements, a handle, and a support place.

7. The cleaning system according to claim 1, wherein the guide is positioned on an upper section of the cleaning hatch.

8. The cleaning system according to claim 1, wherein the guide is positioned on an upper section of the inspection hatch.

9. The cleaning system according to claim 1, wherein the traction cable is a steel cable.

10. The cleaning system according to claim 1, wherein the traction cable is a nylon cable.

11. The cleaning system according to claim 1, wherein the guide is a pulley.

12. The cleaning system according to claim 1, wherein the flexible element is an elastomer.

13. The cleaning system according to claim 1, wherein the flexible element is a polymer.

14. The cleaning system according to claim 1, wherein the plate is composed of metal material.

15. The cleaning system according to claim 1, wherein the plate is composed of polymer material.

* * * * *